US006010045A

United States Patent [19]

Rogers et al.

[11] Patent Number: 6,010,045

[45] Date of Patent: Jan. 4, 2000

[54] ADJUSTABLE CARRIER

[75] Inventors: William H. Rogers; Norman E. Clifton, Jr., both of Jacksonville, Fla.

[73] Assignee: Safariland Ltd., Inc., Ontario, Calif.

[21] Appl. No.: 08/971,391

[22] Filed: Nov. 17, 1997

[51] Int. Cl.[7] ..... F41C 33/02

[52] U.S. Cl. ..... 224/198; 224/197; 224/272; 224/911; 248/298.1; 248/292.12

[58] Field of Search ..... 224/191, 197, 224/198, 199, 200, 271, 272, 911, 912, 910; 248/298.1, 292.12; 403/393; 411/545

[56] References Cited

U.S. PATENT DOCUMENTS

| | | | |
|---|---|---|---|
| 629,699 | 7/1899 | McQueen | 411/545 |
| 3,745,853 | 7/1973 | Deibel et al. | 403/393 |
| 4,504,001 | 3/1985 | Nichols | 224/198 |
| 4,799,610 | 1/1989 | Hsieh | 224/910 |
| 5,018,653 | 5/1991 | Shoemaker | 224/198 |
| 5,265,781 | 11/1993 | Nichols | 224/197 |
| 5,421,497 | 6/1995 | Gilmore | 224/198 |
| 5,467,909 | 11/1995 | Resca et al. | 224/198 |
| 5,692,721 | 12/1997 | Roberts | 248/292.12 |
| 5,875,944 | 3/1999 | Beletsky | 224/198 |

*Primary Examiner*—Gregory M. Vidovich
*Attorney, Agent, or Firm*—Arthur G. Yeager

[57] ABSTRACT

An adjustable carrier for a tool, weapon, or other holsterable object to be attached to any support, including a belt or body harness. The adjustment capability permits the carrier to be clamped in a rigid tilted position as chosen by the wearer of the harness. The adjustment is accomplished by having a pair of vertical spaced and substantially parallel slots and a lower horizontal slot with vertical saw teeth along all shoulders forming the latter slot. Tightenable connectors fit through the vertical slots and another tightenable connector carrying a saw tooth washer positively engages complemental portions of the saw teeth along the shoulders. One or more other spaced openings or slots have a tightenable bolt disposed to attach to threaded connectors. The openings provide for both vertical and/or horizontal adjustments, including tilt or cant, for adjusting the position of the carrier with respect to the holsterable object to suit the user.

14 Claims, 3 Drawing Sheets

ADJUSTABLE CARRIER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Military personnel and police are frequently required to carry a hand weapon, usually a revolver or an automatic pistol, which can rapidly be withdrawn from its holster and made ready to fire. In the past the holster has been supported by a waist belt or by a shoulder harness which allows the holster to shift its position as the human moves about in its activities. Furthermore, even in the absence of any shifting of position, the holster does not come equipped with any fine tuning and quick and positive adjustments that permits each individual to tilt or cant the weapon and the holster into a position desired by that individual for rapid withdrawal for firing.

It is an object of this invention to provide an adjustable holster carrier, or a carrier for any other type of article, e.g., a billy-club, a flashlight, radio, medical instrument, or the like. It is a specific object of this invention to provide a system and the equipment for attaching a gun holster to a waist belt with a selective and quick means for adjusting the tilting position of the holster to provide the most rapid and sure means for withdrawing the gun and assuming a firing position. Still other objects will become apparent from the more detailed description which follows.

BRIEF SUMMARY OF THE INVENTION

This invention relates to an adjustable carrier to which other articles may be attached so that they may be properly positioned; and more particularly, relates to a carrier which is attachable to a waist belt to carry a weapon in an easily accessible and selectively adjustable fixed positions.

This invention relates to a novel combination for attaching a holster to a body harness or belt to provide a means for adjusting the angular position of the holster to suit the wearer. Although this invention has utility in the carrying of tools, medical equipment, cellular telephones and the like; its main use is for mounting a handgun holster in a ready position for withdrawal and use be it on a belt or harness or other support. The adjustment capability of the holster is intended to permit the wearer to quickly and positively position the holster so that the pistol can be rapidly withdrawn for use when needed.

In particular, the weapon which is to be carried is suspended from a belt or harness section and is adjustable angularly with respect thereto and locked in position in that chosen angular attitude. Thereafter when the belt or harness is removed and then later put on to the body, the chosen angular attitude will be the same as originally chosen. Generally further adjustment is not required but when it is ready and quick adjustment may be performed.

In its essence the invention involves a locking arrangement for at least one of three spaced belt attachments which serve to attach the holster to a carrier connecting the holster to the belt or harness. It is a well-known procedure to employ a connecting carrier for attaching a holster to a belt or a harness piece, rather than employ the historical tunnel loop on a holster for suspending it directly from a belt. Such loops are too loose and thereby allow the holster to slide along the belt to positions which do not permit rapid and easy withdrawal of the pistol from the holster. The wasted time of sliding the holster to a convenient location may be sufficient to allow the outlaw to wound or kill the officer struggling with the out-of-place holster before the gun can be withdrawn for use. The present invention provides means to adjust the holster with respect to the belt or harness to provide the desired canted or tilted positioning for the wearer; and it provides a positive means to lock the holster in that position so that in the future, the wearer simply secures the belt or harness in place and the holster is positioned exactly as it is intended to be. The holster is attached to the belt or harness by an intermediary base plate carrier, which is screwed tightly to the belt or harness and to which the holster is attached by T-nuts and bolts that are set in slots in the carrier to provide position adjustment and finally a means to lock the holster in that position to prevent movement therebetween. Mating saw teeth between the carrier and on a bolt washer provides the secure tightening of the washer against the carrier and there can be no relative movement between the two thereafter.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
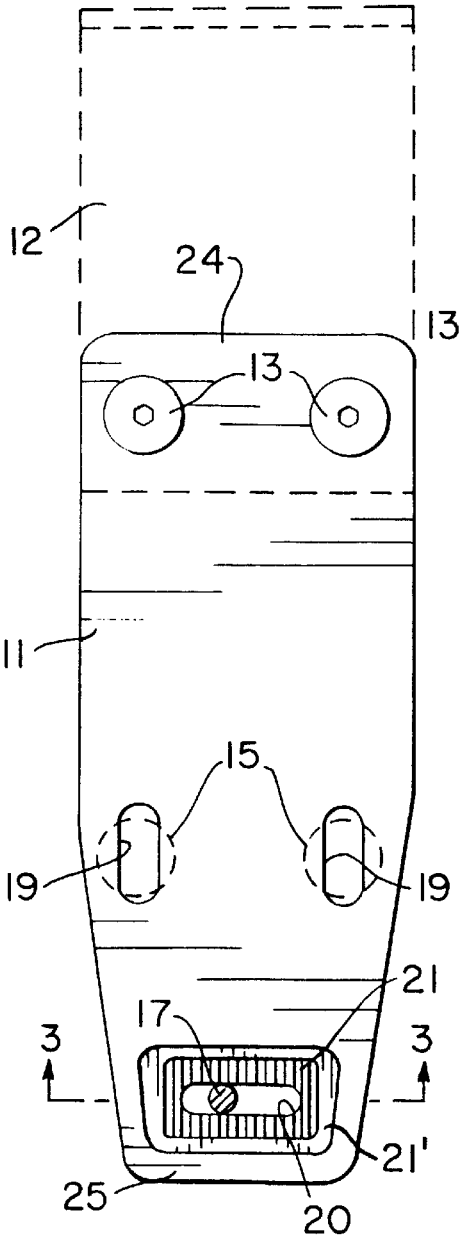
FIG. 1 is a rear elevational view of a first embodiment of the base plate carrier of this invention.

The invention is best understood by reference to the accompanying drawings wherein like reference numerals in the various figures refer to the same feature of the invention.

Figure 2:
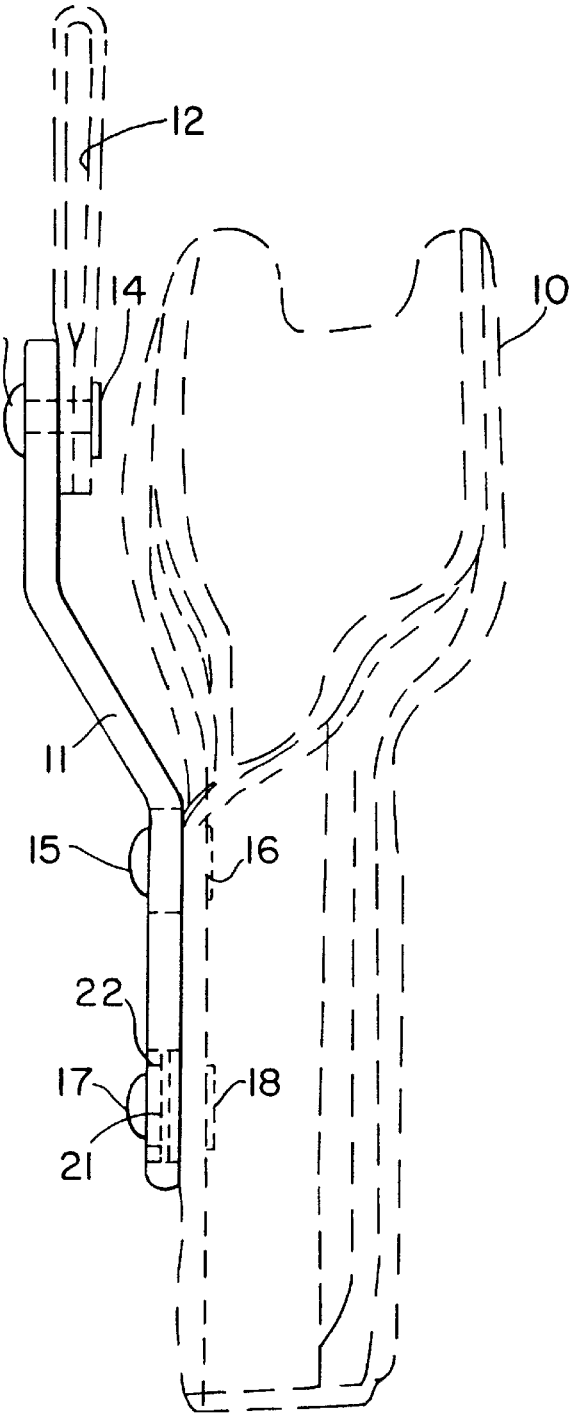
FIG. 2 is a side elevational view of the base plate carrier of FIG. 1.

In FIGS. 1 and 2 a preferred embodiment of the base plate carrier 11 is shown attached to a belt loop 12 by bolts 13 and T-nuts 14. A belt or a harness (not shown) is normally worn by an individual wishing to carry a weapon in a holster. The belt or harness of the individual (not shown here) is threaded through belt loop 12 to provide support for carrying the holstered weapon (not shown). In the normal carrying position belt loop 12 will be at the waist of the individual and carrier 11 will hang generally vertically downward there-from with slot 20 being adjacent the thigh of the individual. This being so the upper end 24 of carrier 11 is normally vertically above lower end 25 of carrier 11.

In the lower portion of carrier 11 there are three slots 19 and 20 for bolts 15 and 17 that are used to attach holster 10 to carrier 11. Slots 19 and 20 generally extend vertically and are preferably positioned at the apices of a triangle with one apex near lower end 25 and the other two apices higher up on carrier 11, generally along a line transverse to the length of carrier 11. Slots 19 are preferably oriented lengthwise of carrier 11 while slot 20 generally extends horizontally and is oriented transverse to carrier 11. These orientations of slots 19 and 20 permit holster 10 to be rotated several degrees forward or rearward from a central vertical alignment with carrier 11, thus providing a wide range of positions to suit almost any preferred and desired position for the holster 10.

Figure 4:
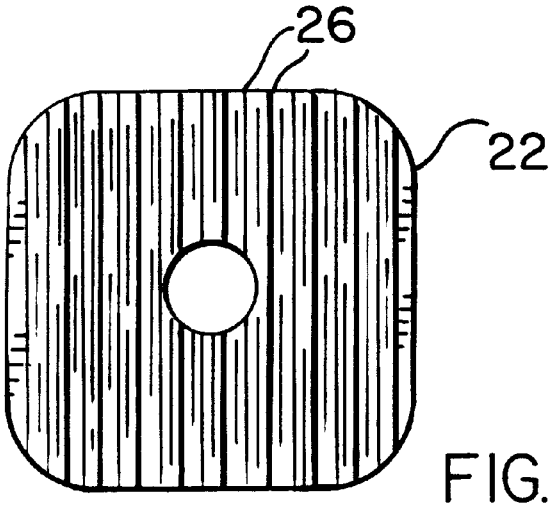
FIG. 4 is a enlarged plan view of the positive locking washer shown in FIG. 3.

In order to provide a locking means to maintain holster 10 in a selected and desired position, slot 20 is provided with a flat clamping zone 21 surrounding slot 20 on carrier 11 and molded therein in a recess 21'. The size of zone 21 is not fixed, but must be sufficient to allow bolt 17 and washer 22 to be moved throughout the slot 20 and to leave space for washer 22 to mate with zone 21. Clamping zone 21 is fashioned with a grooved surface to mate with a similarly grooved surface 26 of washer 22 (FIG. 4). A preferred arrangement is to have surfaces 21 and 26 machined or molded with sawtooth grooves that can mate with each other and positively lock both surfaces against relative movement. With pressure applied by a bolt 17 and a T-nut 18 these surfaces easily and securely lock to each other. It is necessary that carrier 11 and holster 10 be tightened against each other to prevent any rotation of one with respect to the other. It is not necessary for slots 19 to have grooved surfaces and a mating washer to prevent relative movement of carrier 11 and holster 10, but it should be noted that such is intended to be included in this invention. Tightening of the bolts 15 into the T-nuts 16 is all that is required for the holster 10 to be fixed with respect to carrier 11 together with at least one positive locking means in the form of washer 22, clamping zone 21, bolt 17 and T-nut 18.

Figure 3:
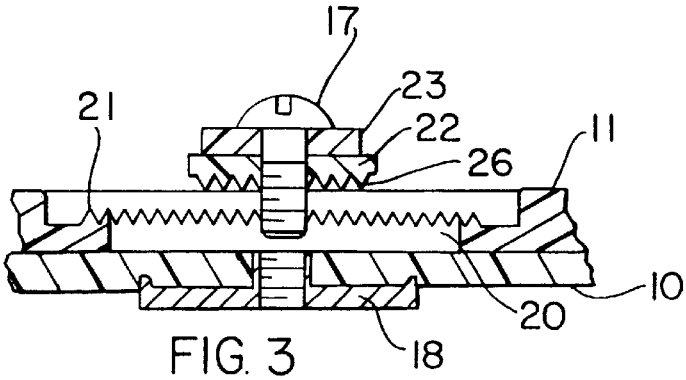
FIG. 3 is a cross-sectional view taken along line 3—3 of FIG. 1.

The drawings, particularly FIG. 3, also show an optional washer 23 as a backup for washer 22, such washer 23 being compressed, whereas washer 22 is not compressed. It is preferred, however, in that it assists in providing a good seat for the engaged head of bolt 17 when it is being tightened into T-nut 18. Washer 22 is preferably a rigid and tough plastic although in certain embodiments it may be metal. Bolts 13, 15 and 17 are metal as well as are T-nuts 14, 16 and 18, but other materials may be employed if desired.

Figure 6:
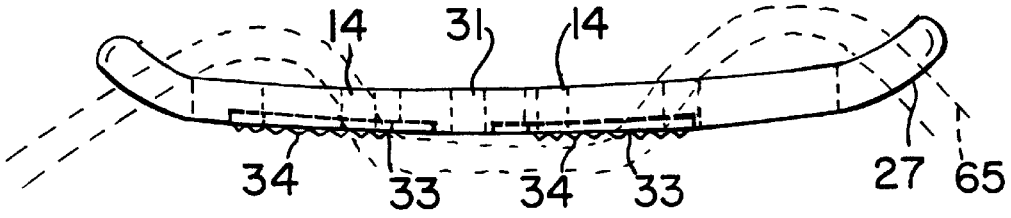
FIG. 6 is a top view of the carrier of FIG. 5.
Figure 5:
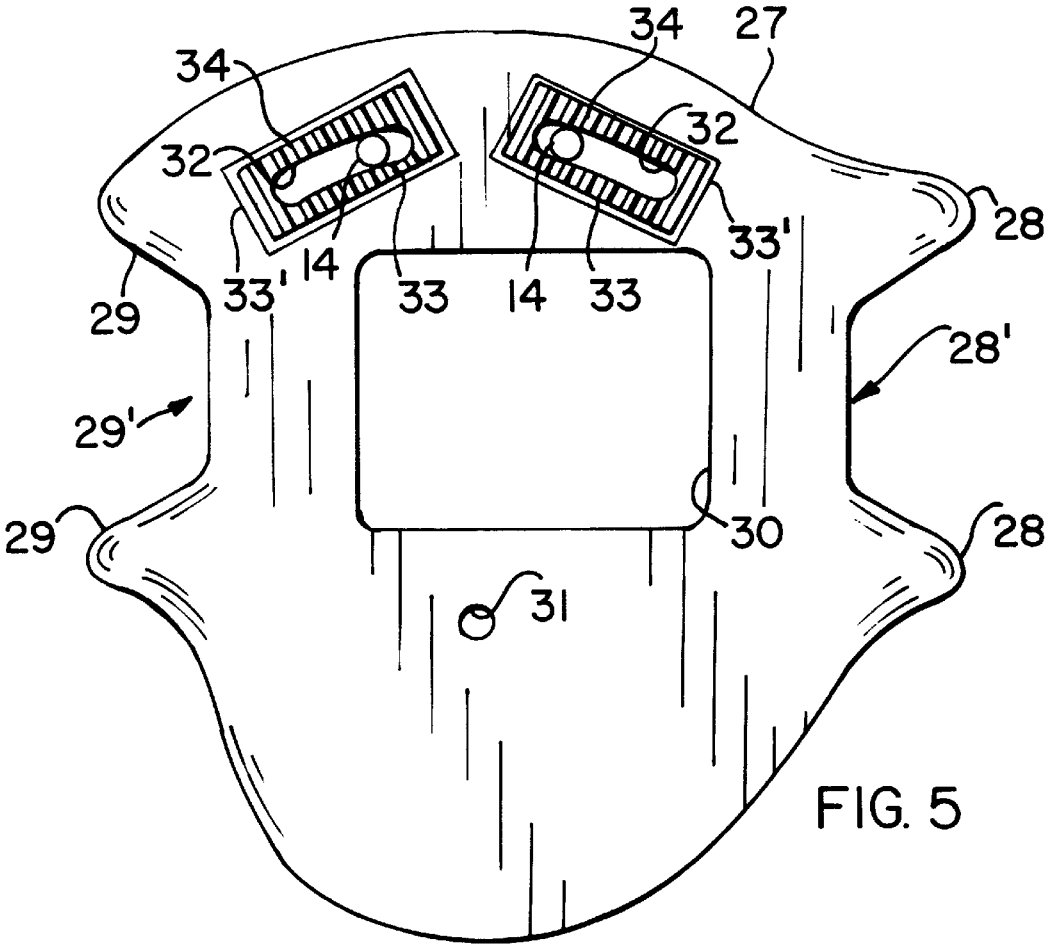
FIG. 5 is a rear elevational view of a second embodiment of the carrier in accord with the present invention.

FIG. 5 illustrates another embodiment of an adjustable carrier 27 which includes two pairs of ears 28, 29 that are angled slightly forwardly with respect to a user to function as slanting sidewalls to form channels 28' and 29' (FIG. 6) to assist in mounting same to a user's belt 65 of 1"–1¾" wide, as understood in the art, for inhibiting movement or rotation of the carrier 27 with respect to the belt. A central space or passageway 30 will accommodate a pant belt loop so that carrier 27 fits snugly against a user's body and keeps it from excessive slippage or other movement on the belt.

The carrier 27 supports a holster (not shown) via hole 31 aligned with a T-nut (not shown) and two spaced arcuate slots 32 surrounded by two molded clamping zones in the form of two sawtooth surfaces 33 each having teeth 34 and formed in recesses 33'. A pair of respective T-nuts (not shown) but similar to T-nut 18, accommodate screws, like screw 17, and two washers, like washer 22 (FIG. 4), to provide for adjustment of the tilt or cant of a holster attached to the carrier 27. Washers, like washer 23, may also be used if desired in the circumstances. It is to be understood that it may be desirable to only use one of the positive locking means, including surfaces 33 in FIG. 5; however, both would provide greater assurance that the cant selected would be maintained.

Figure 7:
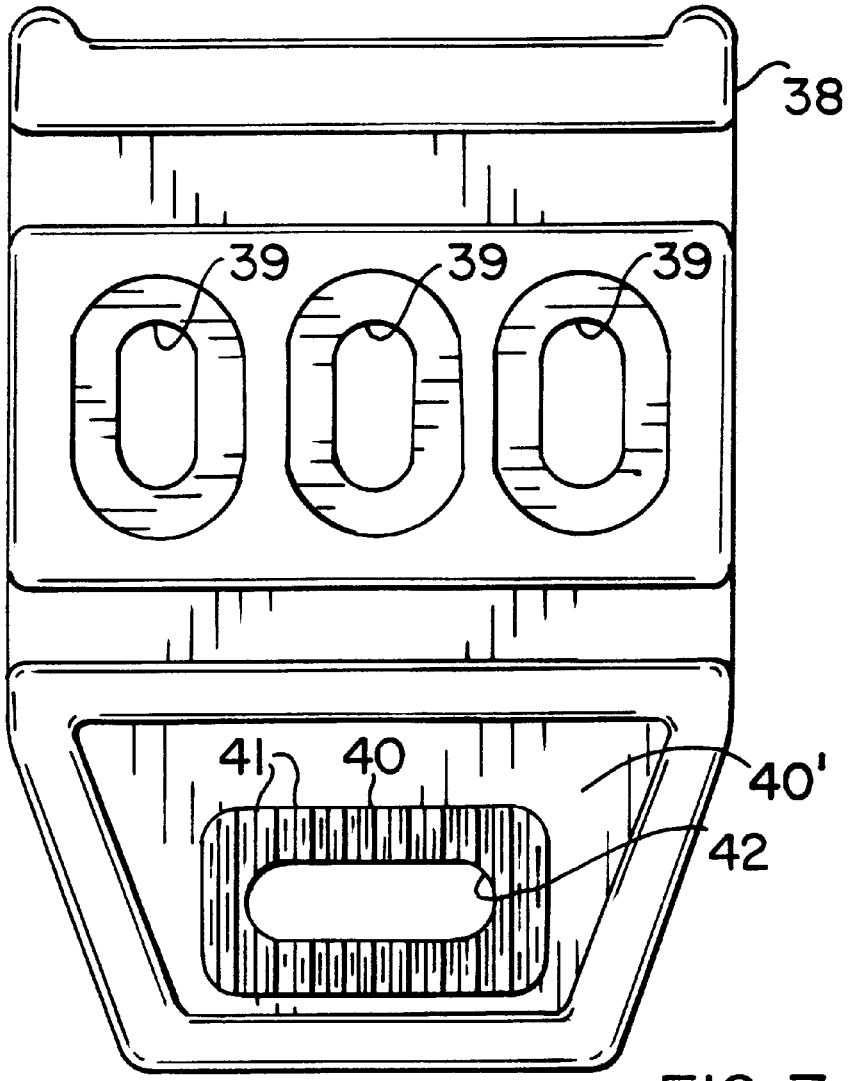
FIG. 7 is a rear elevational view of a third embodiment of the carrier in accord with the present invention.

FIG. 7 illustrates another embodiment of an adjustable carrier 38 which includes three spaced vertical slots 39 above a clamping zone consisting of a sawtooth surface 40 molded into the carrier 38 in recess 40' and having teeth 41 surrounding generally horizontally extending screw slot 42. Again a screw, like screw 17, and a washer, like washer 22, are used to rigidly secure a device such as a holster to the carrier 38. A T-nut, like T-nut 18 (FIGS. 2–3) is used with a screw, like screw 17, with a washer, like 22. Additional washers, like washer 23, may be used if desired.

The carrier 38 may include any conventional means of being attached to a wide police belt by horizontally spaced flanges (not shown) mounted to the interior surface of carrier 38 as desired in the circumstances. The vertical slots 39 are provided in the universal type carrier 38 to enable mounting a single reloader holster thereto by, for example, the left-most slot 39 and with a screw and toothed washer adjacent the left-most end of slot 42 and another reloader holster similarly disposed and connected to the right-most end of slot 42 and the right-most slot 39. The middle slot 39 and slot 42 alternately may be used to secure such a reloader holster. When three point support is desired for a handgun holster, the left and right-most slots 39 would normally be selected together with slot 42.

The number and shape of the teeth or grooves on the various clamping surfaces shown herein is not critical. It is only necessary that the gradations of movement are sufficient to provide the incremental positioning desired by the user. Accordingly the number of teeth or grooves shown is done only for purposes of illustration.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

We claim:

1. An adjustable carrier mountable on an upright wearer for supporting an article and securing it in place after it has been rotated to a desired position by a wearer, said carrier comprising an elongated planar body member having a generally planar surface, an upper portion, a lower portion, and an attachment for attaching said body member to a waist of a wearer, said body member being adapted to be supported in a predetermined position generally vertically on the wearer, an article carrying nut means for carrying an article being attachable to said body member in a manner to be rotatable with respect to said body member, said body member including at least two openings spaced vertically with one said opening being below another said opening and located adjacent said lower portion of said bode member, bolt means extending through each respective said opening and engaged with corresponding said nut means, at least one of said openings being an elongated opening extending generally linear and horizontal and parallel to a horizontal plane, positive locking means engaged with each of at least one said bolt means and said planar surface of said body member surrounding said elongated opening to incrementally and positively affix the position of said article carrying nut means with respect to said elongated body member after said article carrying nut means has been rotated by the wearer to a desired position.

2. The carrier as defined in claim 1 wherein said positive locking means includes a washer having a planar surface and a plurality of teeth thereon, and said surface surrounding said elongated opening includes a generally rectangular recess having a plurality of mating teeth thereon, said elongated opening being located in said recess, said washer teeth when substantially mated with said mating teeth surrounding said elongated opening generally locates said washer planar surface coplanar with said lower portion of said body member surrounding said recess.

3. An adjustable carrier mountable on an upright wearer for supporting an article and securing it in place after it has been rotated to a desired position by a wearer, said carrier comprising an elongated body member having an upper portion, a lower portion, a planar surface, and an attachment means for attaching said body member to a waist of a wearer, an article carrying nut means for carrying an article being attachable to said body member in a manner to be rotatable with respect to said body member, said body member including at least two vertically spaced openings with one said opening being below another said opening and located adjacent said lower portion of said body member, bolt means extending through each respective said opening and engaged with corresponding said nut means, at least one of said openings being an elongated opening extending generally linear and horizontal and parallel to a horizontal plane, interlocking positive locking means engaged with each at least one said bolt means extending through said elongated opening and said planar surface of said body member surrounding said elongated opening to positively affix the position of said article carrying nut means with respect to said body member after said article carrying nut means has been rotated by the wearer to a desired position.

4. The carrier as defined in claim 3 wherein said upper portion includes the other of said vertically spaced openings which comprises three spaced and generally vertical slots, at least one of said bolt means extending through one of said three slots and engaged with one of said nut means, said positive locking means including a pair of interlocking elements.

5. The carrier as defined in claim 4 wherein said pair of interlocking elements includes a washer on said another bolt means passing through said elongated opening and a surface portion surrounding said elongated opening, said washer and said surface portion having generally complemental surfaces which interlock when said bolt means forces said washer into engagement with said surface portion and tightened into its respective said nut means.

6. The carrier as defined in claim 5 wherein said washer has a plurality of teeth extending thereacross, and generally mating teeth located on said surface portion surrounding said elongated opening, said teeth on said washer locking positively with said mating teeth surrounding said elongated opening to fix the relative position of said article article carrying nut means with said body member.

7. The carrier as defined in claim 3 wherein said bolt means extending through said elongated opening is generally slidable between extremities thereof, said positive locking means including a washer having a planar surface and an opposite surface containing teeth and further including teeth disposed on said body member adjacent to said elongated opening and generally mating with said teeth on said opposite surface.

8. The carrier as defined in claim 7 wherein said lower portion includes a generally rectangular recess, said elongated opening being located in said recess, said washer planar surface being disposed substantially coplanar with said lower portion of said body member surrounding said recess when said teeth are fully mated.

9. The carrier as defined in claim 8 wherein said bolt means extending through said elongated opening is adjustable to selected locations between its extremities, said washer being substantially square and being generally the same dimension as a smaller dimension of said rectangular recess.

10. An adjustable carrier mountable on an upright wearer for supporting an article and securing it in place after it has been rotated to a desired position by a wearer, said carrier comprising an elongated plate member having an upper portion, a lower portion, a planar surface, and an attachment for attaching said plate member to a waist of a wearer, an article carrying nut means for carrying an article being attachable to said plate member in a manner to be rotatable with respect to said plate member, said plate member including at least two vertically spaced openings with one said opening being below another said opening and located adjacent said lower portion of said plate member, bolt means extending through each respective said opening and engaged with corresponding said nut means, at least one of said openings being an elongated opening extending generally linear and horizontal and parallel to a horizontal plane, positive locking means engaged with each of at least one said bolt means and surrounding said elongated opening to positively affix the position of said article carrying nut means with respect to said plate member after said article carrying nut means has been rotated by a wearer to a desired position.

11. The carrier as defined in claim 10 wherein said positive locking means includes a washer on one said bolt means passing through said elongated opening and a surface portion surrounding said elongated opening, said washer and said surface portion having complemental surfaces which interlock when said one bolt means forces said washer into engagement with said surface portion and tightened into its respective said nut means.

12. The carrier as defined in claim 11 wherein said complemental surfaces each have a plurality of teeth extending thereacross, said teeth on said complemental surface of said washer locking positively with said teeth on said complemental surface of said surface portion surrounding said elongated opening to fix the relative position of said article with said plate member.

13. The carrier as defined in claim 11 wherein said washer includes a planar surface and said lower portion includes a generally rectangular recess, said elongated opening being located in said recess, said complemental surfaces when interlocked generally locates said washer planar surface coplanar with said lower portion of said plate member surrounding said recess.

14. The carrier as defined in claim 10 wherein said bolt means extending through said elongated opening is generally slidable between extremities thereof, said positive locking means including a washer having a planar surface and an opposite surface containing rectilinear teeth, said positive locking means including rectilinear teeth disposed on said plate member adjacent and substantially perpendicular to said elongated opening and mating with said rectilinear teeth on said opposite surface.

* * * * *